United States Patent [19]

Zieg

[11] 4,408,749

[45] Oct. 11, 1983

[54] VARIABLE PITCH RAILING AND SYSTEM

[75] Inventor: Steven A. Zieg, Anaheim Hills, Calif.

[73] Assignee: Mansion Industries, Inc., City of Industry, California

[21] Appl. No.: 339,877

[22] Filed: Jan. 18, 1982

[51] Int. Cl.[3] ..... E04H 17/14

[52] U.S. Cl. ..... 256/67; 403/168; 52/183; 256/DIG. 2; 256/60

[58] Field of Search ..... 256/67, DIG. 2, 65, 256/60, 59, 24, 22, 21; 403/168; 52/174, 183, 184

[56] References Cited

U.S. PATENT DOCUMENTS

| | | | |
|---|---|---|---|
| 263,324 | 8/1882 | Devoe . | |
| 699,509 | 5/1902 | Finnegan | 256/67 |
| 3,306,586 | 2/1967 | Green | 256/73 |
| 3,995,832 | 12/1976 | Wiese | 52/183 X |
| 4,138,094 | 2/1979 | Thir | 256/67 |
| 4,272,061 | 6/1981 | Suckno . | |

FOREIGN PATENT DOCUMENTS

| | | | |
|---|---|---|---|
| 23698 | 4/1901 | Fed. Rep. of Germany | 52/184 |
| 259042 | 1/1913 | Fed. Rep. of Germany | 52/184 |
| 2837060 | 11/1979 | Fed. Rep. of Germany . | |

*Primary Examiner*—W. L. Shedd

*Attorney, Agent, or Firm*—William W. Haefliger

[57] ABSTRACT

Balusters and rails are angularly adjustable after their assembly to fit the different pitches of stairways. To this end a rail is characterized by:

(a) the rail having an elongated recess sunk in one lateral side thereof, and having at least one interior socket laterally intersecting said recess, (b) the socket configured to pivotally receive the baluster pivot with the baluster projecting from the rail, the socket having an interior laterally facing wall defined by the rail, (c) the recess configured to receive a moulding attached to the rail to laterally confine the pivot in the socket between the moulding and said interior wall, for pivoting in said socket.

8 Claims, 7 Drawing Figures

VARIABLE PITCH RAILING AND SYSTEM

BACKGROUND OF THE INVENTION

This invention relates generally to rail and baluster systems, and more particularly concerns improvements in systems wherein balusters and rails are angularly adjustable after their assembly, to fit the different pitches of stairways.

Conventional installation of balusters and rails is undesirably time consuming as respects cutting balusters to proper angle and length, attaching them to the rails, and filling in the gaps with fillet pieces which must also be cut to length and angle and attached. Due to this conventional installation difficulty, pre-assembled systems have been developed which do not require cutting of balusters, but do require cutting and installation of fillets.

Such current variable pitch systems must be attached to the supporting newel posts while in a pre-assembled condition. This not only is heavy, but is bulky and requires a two-man installation team.

Another aspect of stair systems, whether of conventional or variable pitch, is that they require balusters with squared ends to fit into rail plow. Generally, stairs use two sizes of wood stock from which they are all turned on a lathe. These are usually $1\frac{5}{8}''$ or $1\frac{1}{4}''$ squared end pieces, and must also have rails with proper size plow-different rails for different size balusters. Since homeowners may prefer the thinner or thicker appearing balusters, the industry produces and stocks both sizes of balusters and double inventory of railing. In addition. the current pre-assembled variable pitch systems must be sold in a variety of specific lengths for various installations.

SUMMARY OF THE INVENTION

It is a major object of the invention to provide an adjustable rail and baluster system that will overcome the above described problems with existing systems, and which also constitutes an improvement or improvements, in terms of simplicity, over the system as disclosed in U.S. Pat. No. 4,138,094 to Thir. Basically, the improved rail of the invention is adapted for simple adjustable combination with a pivot at an end of a baluster, the rail characterized by (a) an elongated recess sunk in one lateral side thereof, and having at least one interior socket laterally intersecting said recess, (b) the socket configured to pivotally receive the baluster pivot with the baluster projecting from the rail, the socket having an interior laterally facing wall defined by the rail, (c) the recess configured to receive a moulding attached to the rail to laterally confine the pivot in the socket between the moulding and said interior wall, for pivoting in said socket.

As will be seen, the baluster pivot typically has a spherical or partly spherical outer surface to facilitate ease and rapidity of installation into a pre-formed socket; the recess in the rail has L-shaped interior sides into a lateral one of which the socket is sunk, so as also to intersect the rail outerside facing the baluster to form an opening, whereby the baluster pivot may be sidewardly placed into the socket with the baluster protruding through the opening; and the pivot may be pivotally confined in the socket simply by placing a single moulding in the recess and adhering the moulding to the rail.

Accordingly, no sliding of rail to rail is required, as in the Thir patent. Also, the structure is especially well adapted to wooden rail manufacturing processes.

It is another object of the invention to provide a second rail of similar recess and socket configuration, to receive a similar pivot or pivots at the opposite end of the baluster or balusters, with a second moulding receivable in the recess in the second rail to pivotally confine the pivots in their sockets, whereby the two rail and baluster system retains essential simplicity of construction, and yet is fully adjustable at the stair site to conform to the stair pitch, for rapid installation.

The invention also enables ready removal and replacement of installed balusters, as will be seen.

These and other objects and advantages of the invention, as well as the details of illustrative embodiment, will be more fully understood from the following description and drawings, in which:

DRAWING DESCRIPTION

Figure 4:
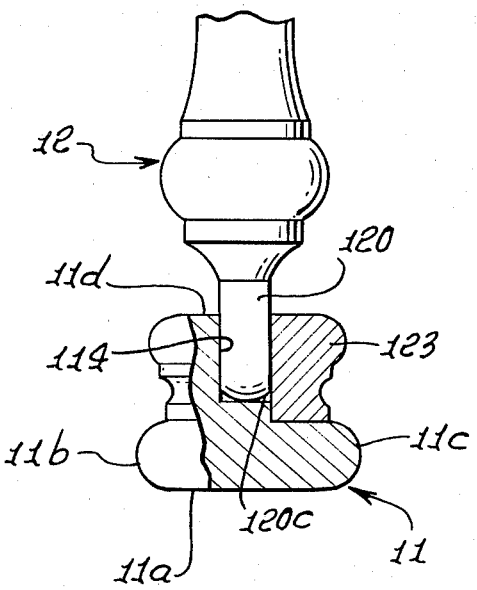
Figure 2A:
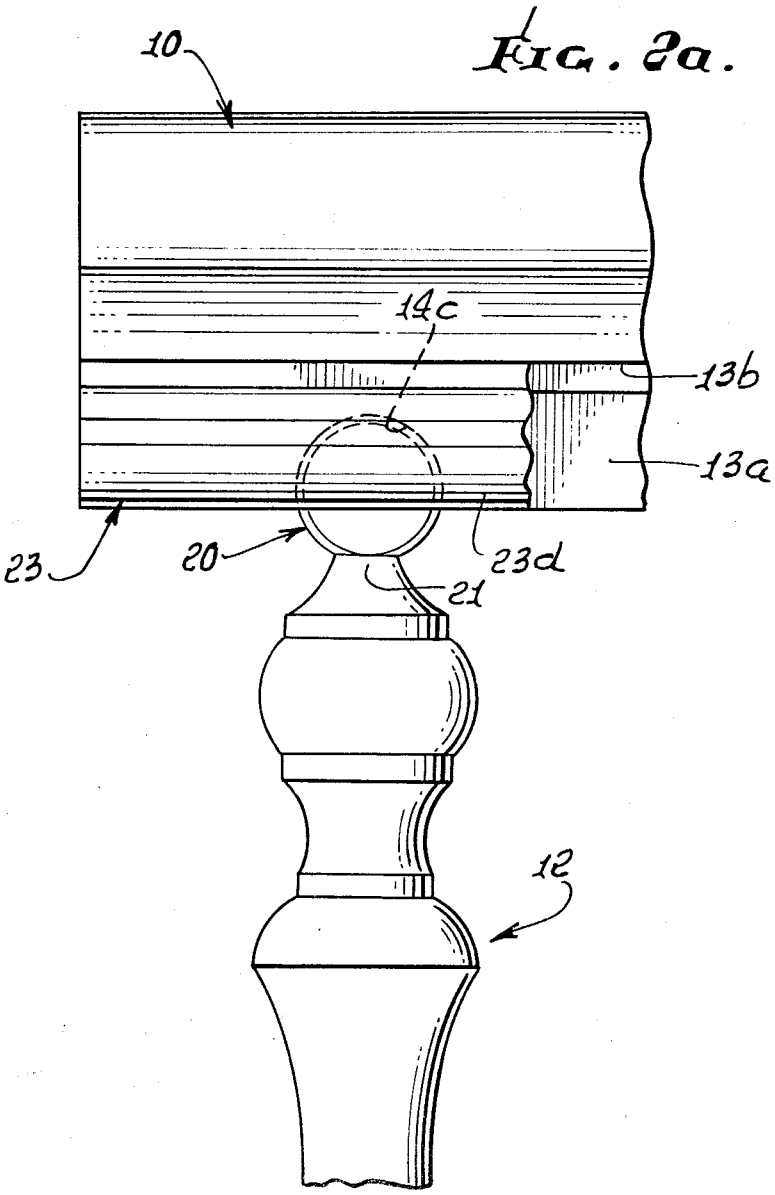
FIG. 2 is a end view taken in section.
Figure 2:
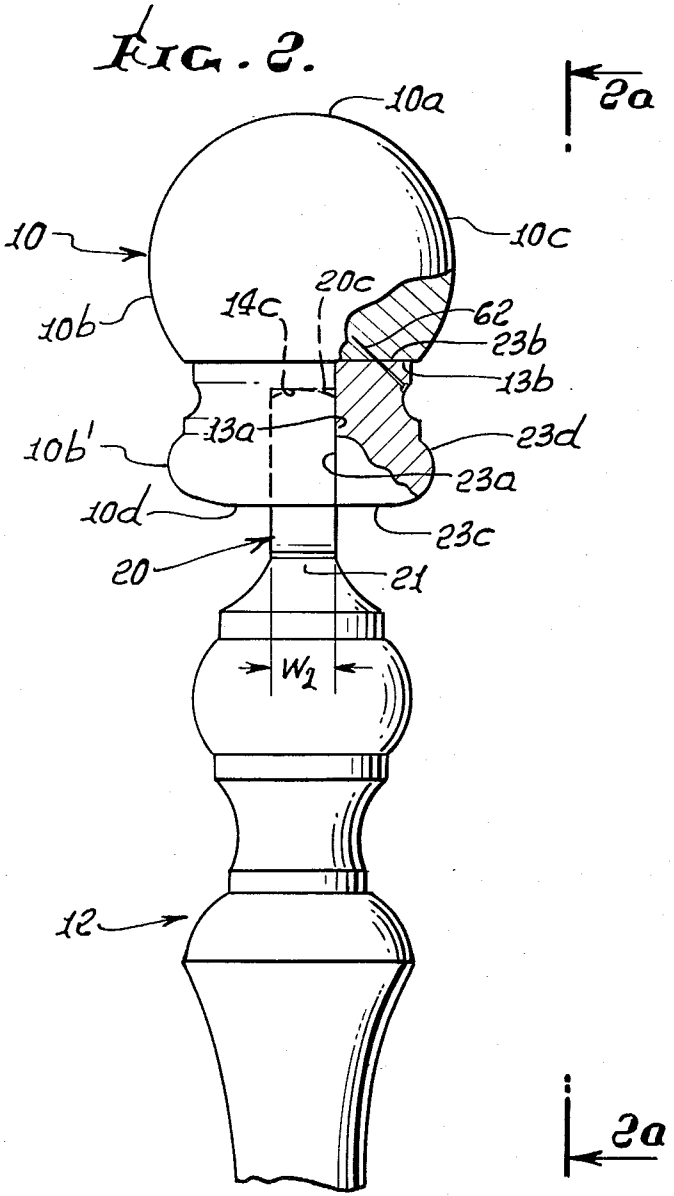
Figure 3:
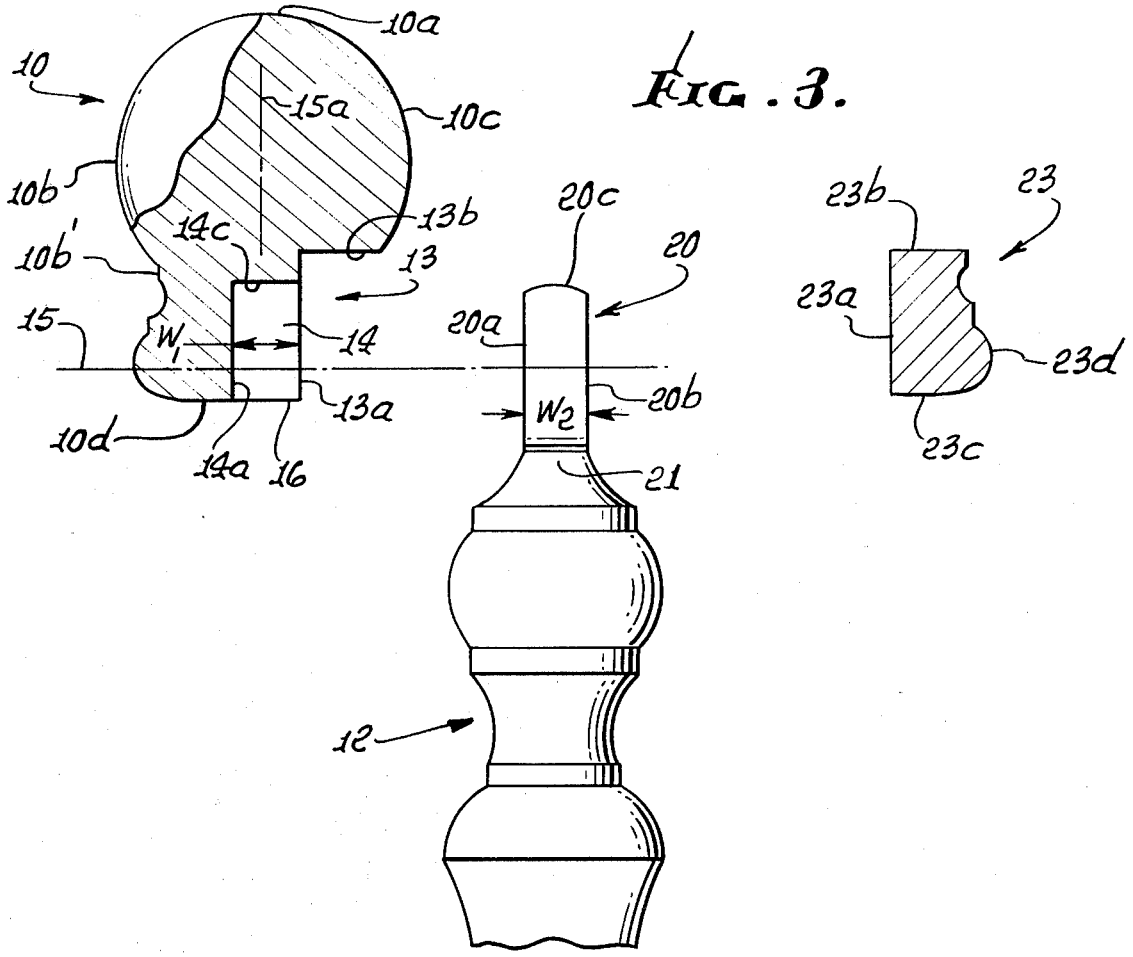
Figure 5:
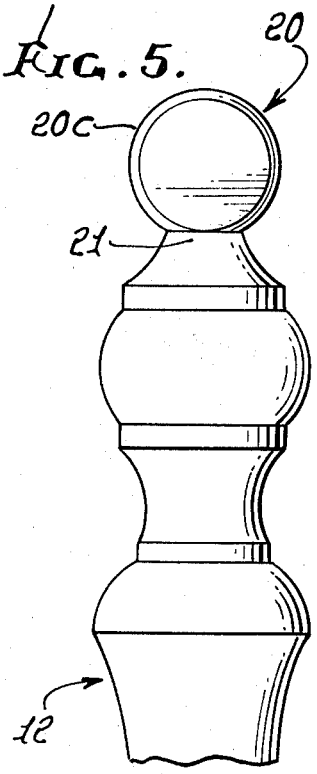
Figure 6:
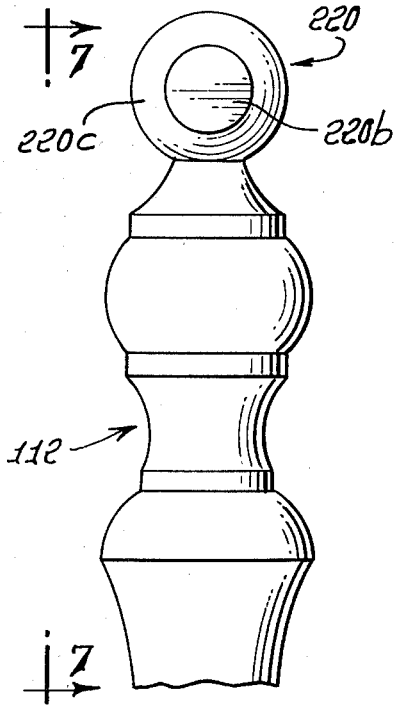

FIG. 2*a* is an elevation taken on lines 2*a*—2*a* of FIG. 2;

FIG. 3 is a fragmentary section;

FIG. 4 is an end view taken in section;

FIG. 5 is a side elevation showing details of the FIGS. 1–4 baluster and pivot;

FIG. 6 is a view like FIG. 5 showing a modified pivot; and

Figure 7:
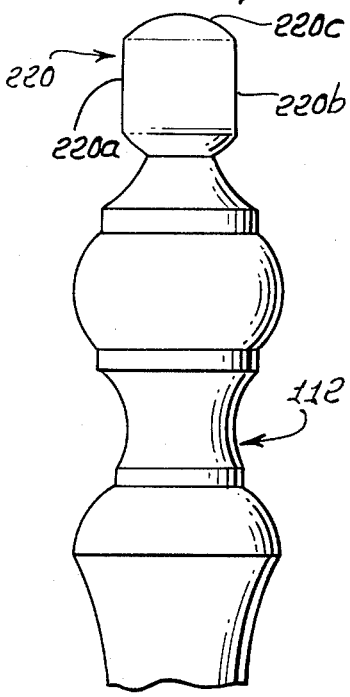

FIG. 7 is a view taken on lines 7—7 of FIG. 6.

DETAILED DESCRIPTION

In FIGS. 1–4, upper and lower rails 10 and 11, as used adjacent stairways or passageways, are interconnected by balusters 12. Such rails and balusters may consist of wood or other materials. Rail 10 has upper side 10*a*, laterally opposite sides 10*b* and 10*c*, and a bottom side 10*d* from which the balusters protrude. Likewise, lowe rail 11 has a lower side 11*a* attachable to stairway or other structure, laterally opposite sides 11*b* and 11*c*, and an upper side 11*d* from which balusters 12 protrude.

The upper rail 10 has an elongated recess 13 sunk in its lateral side 10*c*, and also intersecting rail side 10*d* as well. The recess may typically have or be bounded by L-shaped interior walls 13*a* and 13*b*, the former facing laterally and the latter downwardly. As a consequence, the recess may easily be cut into the rail as by a milling cutter. In addition, the rail 10 also has at least one, and normally a number of interior sockets 14 formed therein at intervals spaced along the rail corresponding to baluster intervals and sunk into interior wall 13*a*. Each socket 14 is typically cylindrical, but with a lateral axis 15 spaced closer to the bottom side 10*d* than the socket radius dimension. The axis 15 is generally normal to a vertical plane 15*a* bisecting the rail. Socket cylindrical inner wall appears at 14*c*.

Accordingly, the socket, intersects the bottom side 10*d* to form a rectangular opening 16 therein, that opening having a width "$\omega_1$" the same as the socket depth, and a length "1" which is between about 9/8 r and 15/8 r, where "r" is the socket radius. The angle $\alpha$ subtended by radii extending from the axis 15 to the ends 16*a* and 17 of the rectangular opening is typically between about 100° and 170°. This allows for wide angular adjustment of the balusters and rails, during installation of a rail and baluster system, as adjacent a stairway as will be seen.

In this regard, the socket is configured to receive a pivot at the end of a baluster, with the baluster projecting from the rail; and in addition, each recess is configured to receive a molding to be removably or permanently attached to the rail so as to laterally confine the pivot in the socket, while accommodating adjustment pivoting thereof.

In the drawings, the pivot 20 is shown as having shape to fit the socket, with opposite flat sides 20*a* and 20*b*, and a spherical outer surface 20*c*, that merges with a baluster neck 21. The width "$\omega_2$" of the pivot is substantially less than the length "l" of the opening 16, and slightly less than the width $\omega_1$ of that opening. Also the outer diameter of the pivot is approximately the same as the diameter of the socket, having a snug fit therewith when lightly pressed into the socket. The spherical curvature of interrupted surface 20*c* facilitates ease of assembly of the pivot into the socket despite small variances in dimension occurring in production.

Elongated molding 23 is receivable in the recess and attached to the rail to closely confine the pivot for adjustable rotation in the socket between socket inner flat wall 14*a* and molding inner flat wall 23*a*. Such adjustment allows relative rotation of the baluster and railing through an angle $\beta$ shown in FIG. 1, as during installation of the railing and baluster system. The moulding also has a wall 23*b* extending at 90° to wall 23*a* and L shaped walls 23*a* and 23*b* may for example be adhesively bonded to rail recess L-shaped walls 13*a* and 13*b* respectively. Further, moulding bottom side 23*c* may form a continuation of rail bottom side 10*d*, as shown, and the molding lateral side 23*d* may conform in outline to the extent 10*b*′ of lateral side 10*b*.

FIG. 4 shows that cylindrical pivots 120 at the opposite ends of the balusters, and like pivots 20, are similarly retained in bottom rail sockets 114 by moulding 123, like moulding 23, the construction being generally the same. Note spherical surface 120*c* of pivot 120.

Figure 1:
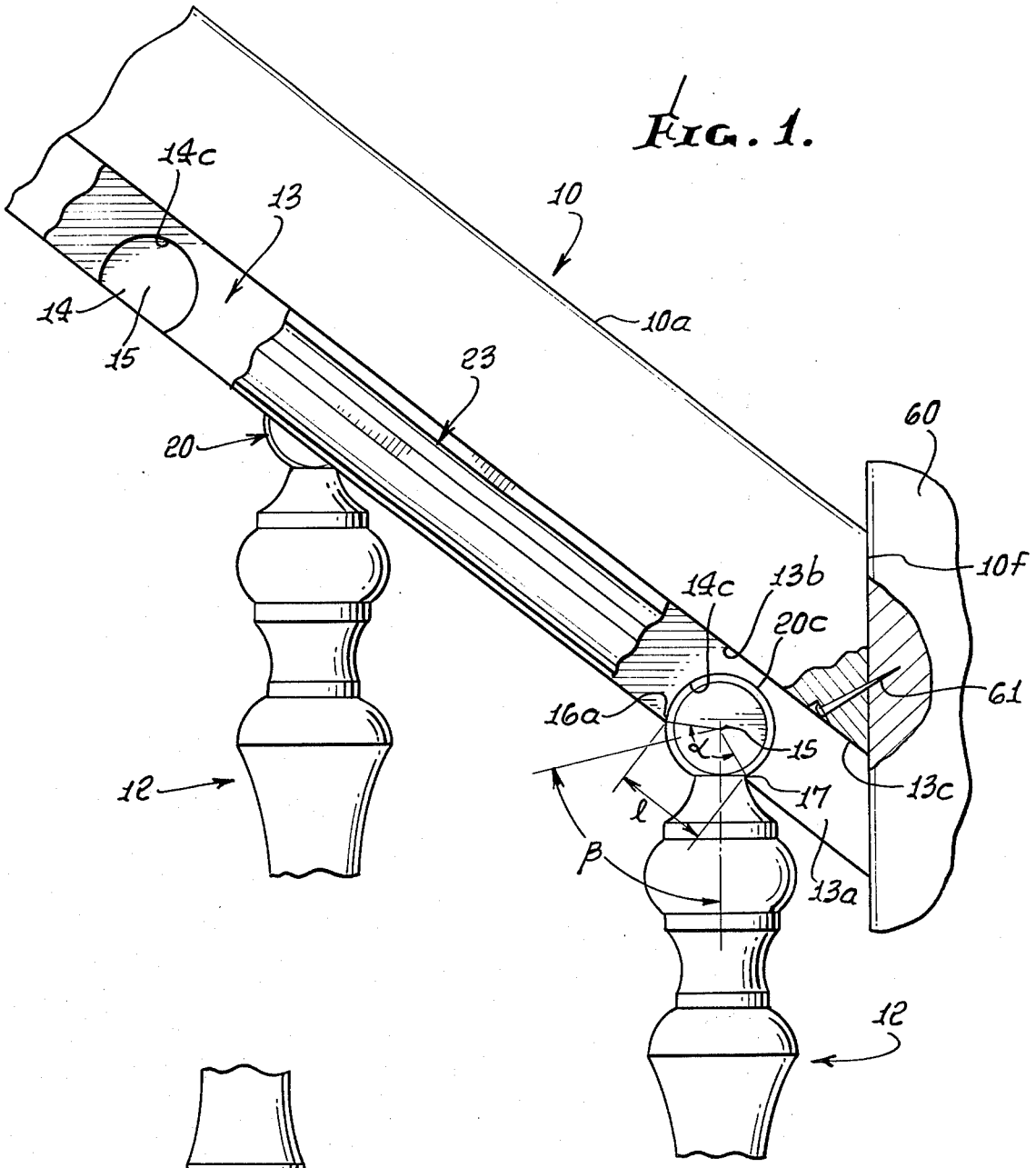
FIG. 1 is a side elevation.

In FIG. 1, a method and means of attaching the baluster at the end of the rail to a post 60 is shown. A nail or other fastener 61 is inserted into position, projecting from proximate the intersection 13*c* of recess walls 13*a* and 13*b* angularly through the end 10*f* of the rail, and into the post 60, and for concealment. Other methods may be used.

The invention facilitates ease of removal and replacement of installed balusters, as follows: the moulding 23 is first removed, as by removing nails holding the moulding to the rail. (see removable nails 62 in in FIG. 2). The pivots may then be popped out of their sockets, due to very low frictional resistance between spherical surfaces 20*c* and socket cylindrical walls 14*c*. A new baluster or balusters may then be inserted, and moulding 23 replaced. Accordingly, broken balusters may be replaced, and new design or style balusters may be employed, as required for redecoration purposes.

FIGS. 6 and 7 show a baluster 112 with a modified, i.e. thicker pivot 220, having spherical surface 220*c* intersecting parallel flat sides 220*a* and 220*b*.

Important advantages of the above structure and its use include

1. Only one moulding required to retain baluster pivots in sockets; integrity of rail maintained, with minimum disruption.
2. No need for time consuming cutting of baluster lengths or angles.
3. Variable pitch, from 0 to 45, of baluster and rail units.
4. No cutting or installation of fillets required.
5. All components may be shipped and inventoried separately.
6. Installation of separate pieces eliminates handling of bulky pre-assembled units.
7. One rail size fits any size baluster. No need for different rails for different balusters.
8. Rails may be attached conventionally or with easy-hang hardware.
9. No nailing or attachment of balusters is needed, since they self-lock to both top and bottom railing.
10. Installation always looks neat without potential sloppy cutting and installation of fillet pieces.
11. The rail having one continuous pivot retaining wall (afforded by the moulding 23) provides for faster assembly, and increased strength.
12. Although upper and lower rails may have different shapes which facilitate installation, both use a common molding pivot retainer strip which fits into the same size L-shaped elongated recess in both top and bottom rails. The commonality of retainer strip molding provides for ease of manufacture and inventory.
13. Spherical formations or pivots at ends of vetical members may be formed at the same time in the same process as the decorative sculpture is cut into the vertical members. A part of the sphere is then removed to maintain linear orientation with the rail. This provides for ease of manufacture.
14. The spheres or partial spheres may be more easily inserted into cylindrical sockets due to the radius or curvature of resultant spherical shapes. This speeds installation and permits variances in dimension.

I claim:

1. For use in a connection between a one-piece rail and at least one baluster having a pivot at an end thereof, the improvement comprising (a) the rail having an elongated recess sunk in one exterior lateral side thereof, and having at least one interior socket laterally intersecting said recess, (b) the socket having a curved wall that pivotally receives the baluster pivot with the baluster projecting from the rail, the socket having an interior laterally facing wall defined by the rail, said curved wall and said laterally facing wall being of one-piece with the rail, (c) the recess having L-shaped interior sides that receive and confine an exterior moulding fitting to the rail which laterally confines the pivot in the socket between the moulding and said interior wall, that providing pivoting in said socket, said L-shaped interior sides being laterally exposed to the exterior.

2. The improvement of claim 1 wherein said socket is generally cylindrical and defines a lateral axis generally normal to a plane bisecting the rail.

3. The improvement of claim 1 wherein said rail has an elongated notch formed therein adjacent a corner formed by said L-shaped interior sides.

4. The combination that includes the rail of claim 1 and said moulding received in said recess and attached to the rail for laterally confining the pivot in the socket.

5. The combination that includes the rail of claim 3 and said moulding received in said recess and attached to said L-shaped interior sides of the rail thereby laterally confining the pivot in the socket.

6. The combination of any one of claims 4 or 5 wherein the moulding has a laterally facing outer side configured to match a corresponding laterally oppositely facing side portion of the rail.

7. The combination of any one of claims 4 or 5 including sad baluster with said pivot confined in said socket to pivot therein, the pivot having a spherical surface.

8. The combination of claim 6 including said baluster with said pivot in said socket, and wherein the baluster has another pivot at the opposite end thereof and there being a second rail, and including (d) the second rail having an elongated recess sunk in one lateral side thereof, and having at least one interior socket laterally intersecting said recess, (e) the socket in the second rail configured to pivotally receive the baluster other pivot with the baluster projecting from the rail, the socket having an interior laterally facing wall defined by the rail, (f) and a second moulding received in said recess in the second rail and attached to the second rail to pivotally confine said other pivot in the socket in the second rail.

* * * * *